US007431015B2

(12) United States Patent
Mahoney et al.

(10) Patent No.: US 7,431,015 B2
(45) Date of Patent: Oct. 7, 2008

(54) FUEL METERING SYSTEM PROPORTIONAL BYPASS VALVE ERROR COMPENSATION SYSTEM AND METHOD

(75) Inventors: Timothy D. Mahoney, Chandler, AZ (US); Steven A. Lewis, South Bend, IN (US)

(73) Assignee: Honeywell International Inc., Morristown, NJ (US)

( * ) Notice: Subject to any disclaimer, the term of this patent is extended or adjusted under 35 U.S.C. 154(b) by 229 days.

(21) Appl. No.: 11/344,641

(22) Filed: Jan. 31, 2006

(65) Prior Publication Data

US 2007/0175449 A1 Aug. 2, 2007

(51) Int. Cl.
*F02M 37/00* (2006.01)
*F02G 3/00* (2006.01)

(52) U.S. Cl. ..... 123/434; 60/39.281; 60/39.01; 60/793

(58) Field of Classification Search ..... 123/434; 60/39.281, 39.01, 793
See application file for complete search history.

(56) References Cited

U.S. PATENT DOCUMENTS 3,393,691 A 7/1968 Longstreet et al.
4,337,616 A * 7/1982 Downing ..... 60/39.281
4,423,592 A 1/1984 Evans
4,452,207 A 6/1984 Moore, Jr.
4,672,806 A 6/1987 Pisano
4,716,723 A 1/1988 Ralston et al.
4,833,880 A 5/1989 Chapin
4,993,221 A 2/1991 Idelchik
5,133,181 A 7/1992 Moore, Jr.
5,553,589 A 9/1996 Middleton et al.
5,715,674 A 2/1998 Reuter et al.
5,806,300 A 9/1998 Veilleux, Jr. et al.
6,178,997 B1 1/2001 Adams et al.
6,317,680 B1 11/2001 Luttrell et al.
6,751,942 B2 6/2004 Mahoney et al.
6,810,674 B2 11/2004 Clements
2005/0223690 A1 10/2005 Wemberg et al.

* cited by examiner

*Primary Examiner*—Stephen K. Cronin
*Assistant Examiner*—J. Page Hufty
(74) *Attorney, Agent, or Firm*—Ingrassia, Fisher & Lorenz, P.C.

(57) ABSTRACT

A method and system for controlling fuel flow in a fuel metering system that includes a metering valve and a proportional bypass valve that produces a differential pressure error across the metering valve includes supplying a first fraction of fuel through the metering valve. A second fraction of the fuel is directed through the proportional bypass valve. The differential pressure error produced by the bypass valve is determined, and fuel flow through the supply line is controlled by adjusting the metering valve based at least in part on the determined differential pressure error, and by adjusting the proportional bypass valve to maintain a substantially constant metering valve differential pressure across the metering valve.

23 Claims, 2 Drawing Sheets

FUEL METERING SYSTEM PROPORTIONAL BYPASS VALVE ERROR COMPENSATION SYSTEM AND METHOD

TECHNICAL FIELD

The present invention relates to gas turbine engine fuel flow control and, more particularly, to a system and method for providing proportional bypass valve error compensation for fuel flow control systems that include these valves.

BACKGROUND

Typical gas turbine engine fuel supply systems include a fuel source, such as a fuel tank, and one or more pumps that draw fuel from the tank and deliver pressurized fuel to the fuel manifolds in the engine combustor via a main supply line. The main supply line may include one or more valves in flow series between the pumps and the fuel manifolds. These valves generally include at least a main metering valve and a pressurizing-and-shutoff valve downstream of the main metering valve. In addition to the main supply line, many fuel supply systems also include a bypass flow line connected upstream of the metering valve that bypasses a portion of the fuel flowing in the main supply line back to the inlet of the one or more pumps, via a bypass valve. The position of the bypass valve is typically controlled by a head regulation scheme to maintain a substantially fixed differential pressure across the main metering valve.

The above-described fuel supply system, in many instances, uses a proportional head regulation control scheme. While generally safe, reliable, and robust, a proportional control scheme can suffer certain drawbacks. In particular, it can result in an error (or "droop") of the controlled pressure drop, which may be relatively significant. For example, the error can be up to about 4% in some systems. To substantially eliminate this proportional droop error, some systems have implemented a proportional plus integral control scheme. While this alternative works generally well, and is also generally safe, reliable, and robust, it also suffers certain drawbacks. For example, it can result in increased system complexity and cost.

Hence, there is a need for a system and method of providing compensating for proportional pressure droop error in fuel flow control systems that does not result in increased system complexity and/or system cost. The present invention addresses one or more of these needs.

BRIEF SUMMARY

The present invention provides a fuel metering system proportional bypass valve error compensation system and method. In one embodiment, and by way of example only, in a fuel metering system that includes a metering valve and a proportional bypass valve that produces a differential pressure error across the metering valve, a method of controlling fuel flow in the fuel metering system includes supplying fuel from a fuel source to a supply line that has at least an outlet port. A first fraction of the fuel in the supply line is directed through the metering valve, which has a first variable area flow orifice, to the supply line outlet port. A second fraction of the fuel in the supply line is directed through the proportional bypass valve, which has a second variable area flow orifice, back to the fuel source. The differential pressure error produced by the bypass valve is determined. Fuel flow to the supply line outlet port is controlled by adjusting the area of the first variable area flow orifice based at least in part on the determined differential pressure error, and by adjusting the area of the second variable area flow orifice to maintain a substantially constant metering valve differential pressure across the first variable area orifice.

In another exemplary embodiment, a fuel metering system for controlling fuel flow to a gas turbine engine includes a fuel supply line, a metering valve, a bypass flow line, a proportional bypass valve, and a control circuit. The fuel supply line has an inlet adapted to couple to a fuel source and an outlet adapted to couple to the gas turbine engine. The metering valve is positioned in flow-series in the supply line, and produces a differential pressure thereacross when fuel flows therethrough. The bypass flow line is coupled to the fuel supply line upstream of the metering valve for bypassing a portion of the fuel in the supply line back to the inlet. The proportional bypass valve is positioned in flow-series in the bypass flow line and is configured to control flow therethrough to maintain a substantially constant differential pressure, which includes a differential pressure error produced by the proportional bypass valve, across the metering valve. The control circuit is adapted to receive a fuel flow command representative of a desired fuel flow and is operable to determine the differential pressure error, and to adjust the metering valve, based at least in part on the determined differential pressure error and the fuel flow command, to supply fuel through the metering valve to at the desired fuel flow.

Other independent features and advantages of the preferred system and method will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
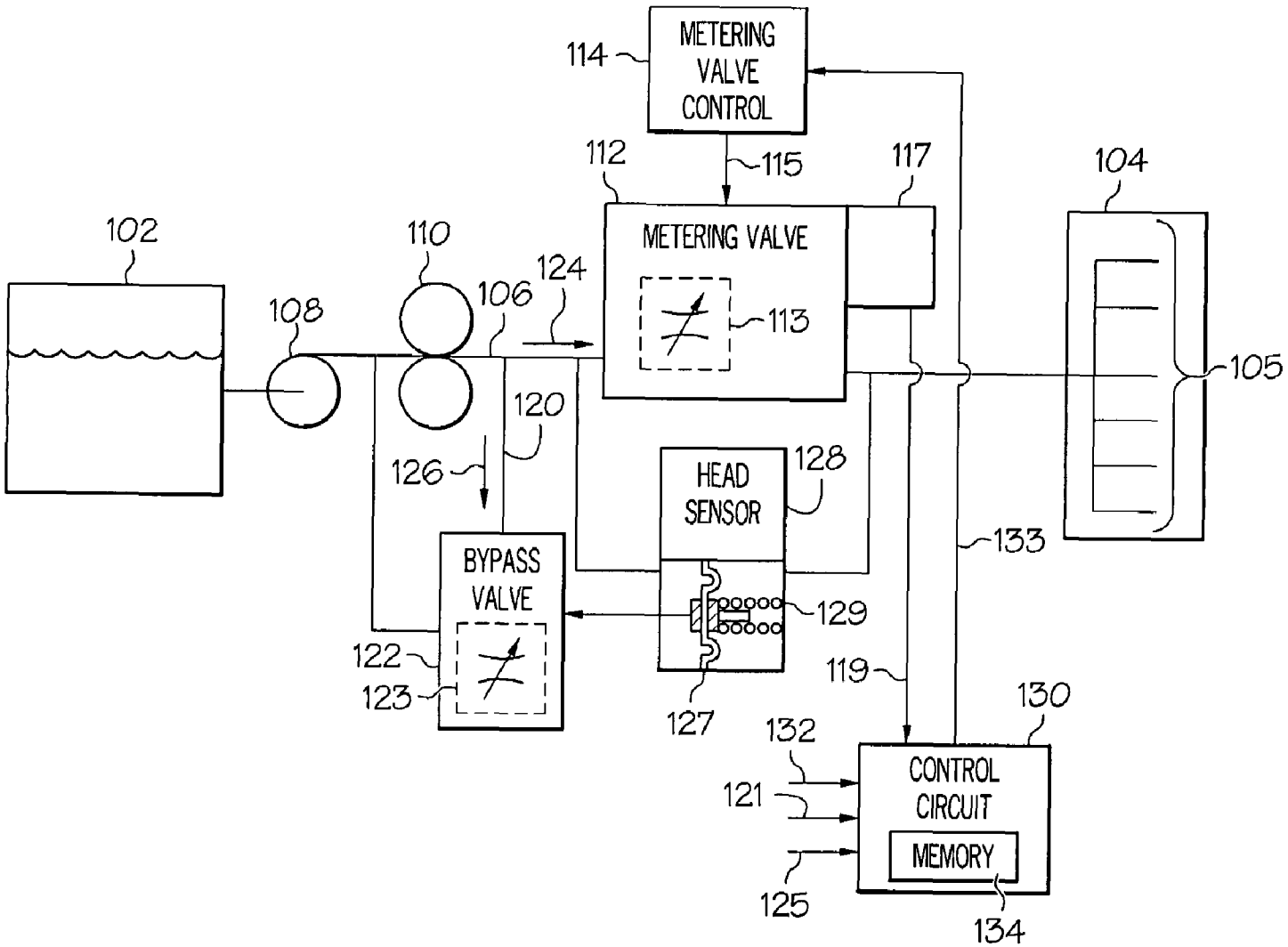
FIG. 1 is a block diagram of fuel delivery and control system for a gas turbine engine according to an exemplary embodiment of the present invention.

A fuel delivery and control system for a gas turbine engine, such as a turbofan jet aircraft engine, according to one exemplary, is depicted in FIG. 1. The system 100 includes a fuel source 102, such as a tank, that stores the fuel supplied to a jet engine combustor 104. A supply line 106 is coupled to the fuel source 102 and, via various components, delivers the fuel to the combustor 104 via a plurality of fuel nozzles 105. It is noted that the supply line 106 is, for convenience, depicted and described with a single reference numeral. However, it will be appreciated that the system 100 may be implemented using separate sections of piping, though a single section is certainly not prohibited.

One or more engine-driven pumps are positioned in flow-series in the supply line 106 and draw fuel from the fuel source 102. In the depicted embodiment, a booster pump 108, such as a relatively low horsepower centrifugal pump, and a high pressure fuel pump 110, such as a positive displacement pump, are used. The booster pump 108 draws fuel directly from the fuel source 102 and provides sufficient suction head for the high pressure pump 110. The fuel pump 110 then supplies the fuel, at a relatively high pressure, such as up to 1200 psig, to the remainder of the supply line 106.

A metering valve 112 is positioned in flow-series in the supply line 106 downstream of the fuel pump 110. The metering valve 112 includes a first variable area flow orifice 113 through which a portion of the fuel in the supply line 106 flows. A metering valve control device 114 is used to adjust the position of the metering valve 112, and thus the area of the first variable area flow orifice. In the depicted embodiment, the metering valve 112 is a hydraulically-operated valve and the metering valve control device 114 is an electro-hydraulic servo valve (EHSV) that supplies a metering valve control signal output 115. The control signal output 115 from the metering valve control device 114 is coupled to the metering valve 112 and is used to adjust the position of the metering valve 112 by controlling the flow of operational hydraulic fluid to the metering valve 112.

It will be appreciated that the metering valve 112 and control device 114 described above are only exemplary of a particular embodiment, and that each may be implemented using other types of devices. For example, the metering valve 112 could be an electrically operated valve. In this case, a control device 114, such as an EHSV, may not be used, or the control device 114 could be implemented as an independent controller. In any case, as will be described further below, fuel flow rate to the combustor 104 is controlled by adjusting the position of the metering valve 112, and thus the area of the first variable area flow orifice 113, via the metering valve control device 114.

A position sensor 117 is coupled to the metering valve 112, and is used to sense the metering valve's position and supply a valve position signal 119. The position of the metering valve 112 is directly related to the area of the first variable area flow orifice 113, which, as will be discussed further below, is directly related to the fuel flow rate to the combustor 104. The position sensor 117 is preferably a dual channel linear variable differential transformer (LVDT), but could be any one of numerous position sensing devices known in the art. For example, the position sensor 117 could be a rotary variable differential transformer (RVDT), an optical sensor, a float-type sensor, or the like.

A bypass flow line 120 is connected to the supply line 106 between the fuel pump 110 and the metering valve 112, and bypasses a portion of the fuel in the supply line 106 back to the inlet of the fuel pump 110. It will be appreciated that the present invention is not limited to bypassing a portion of the fuel back to the inlet of the fuel pump 110, but also includes embodiments in which the fuel is bypassed back to the inlet of the booster pump 108, or back to the fuel source 102.

A proportional bypass valve 122 is positioned in flow-series in the bypass flow line 120, and includes a second variable area flow orifice 123 through which fuel in the bypass flow line 120 flows. Thus, as indicated by the flow arrows in FIG. 1, a first fraction 124 of the fuel in the supply line 106 is directed through the metering valve 112, and a second fraction 126 is directed through the proportional bypass valve 122. The absolute (and relative) magnitudes of the first fraction 124 and second fraction 126 are controlled by adjusting the areas of the first 113 and the second 123 variable area flow orfices.

The position of the proportional bypass valve 122, and thus the area of the second variable area flow orifice 123, is adjusted under the control of a head sensor 128. The head sensor 128 is configured to sense the differential pressure (ΔP) between the inlet and outlet of the metering valve 112. The head sensor 128, which is coupled to the proportional bypass valve 122, adjusts the area of the second variable area flow orifice 123 based on the sensed ΔP. In particular, the head sensor 128, implementing proportional control, adjusts the area of the second variable area flow orifice 123 to maintain a substantially constant, predetermined ΔP across the metering valve 112. The reason for this will be discussed in more detail below.

It will be appreciated that the head sensor 128 may be any one of numerous types of sensors known in the art. In a particular preferred embodiment, the head sensor 128 is a thermally-compensated, spring-loaded, diaphragm-type sensor. The head sensor 128 is coupled to the proportional bypass valve 122, and includes a diaphragm 127 across which the metering valve differential pressure is applied, and a spring 129 disposed on one side of the diaphragm 127. It will be appreciated, however, that the head sensor 128 may be implemented using any one of numerous methods. For example, the diaphragm may be replaced with an equivalent servo-valve. Its selection may be dependent, for example, on the fuel system 100 arrangement and type of valve used for the proportional bypass valve 122.

A control circuit 130, which may be implemented within an engine controller, such as a Full Authority Digital Engine Controller (FADEC) or other electronic engine controller (EEC), controls the flow of fuel to the combustor 104. To do so, the control circuit 130 receives various input signals and controls the fuel flow rate to the combustor 104 accordingly. In particular, the control circuit 130 receives an input control signal 132 from, for example, throttle control equipment (not illustrated) in the cockpit, the position signal 119 from the position sensor 117, a compressor discharge pressure signal 121 representative of the discharge pressure from the compressor in the non-illustrated engine, and an ambient pressure signal 125 representative of ambient pressure around the system 100. The control circuit 130, in response to these signals, supplies a drive signal 133 to the metering valve control device 114. In response to the drive signal 133, the metering valve control device 114, as was described above, adjusts the area of the first variable area flow orifice 113 to obtain the desired flow rate to the combustor 104. Specifically, the fuel flow rate ($W_F$) to the combustor 104 is controlled in accordance with the following flow equation (Equation 1):

$$W_F = K_1 \times A_{MV} \times \sqrt{\Delta P},$$

where $K_1$ is a flow constant that is a function of fuel density, fuel temperature, and metering valve discharge coefficient (CD), $A_{MV}$ is the area of the first variable area flow orifice 113, which is a known function of metering valve valve position, and ΔP is the differential pressure across the metering valve 112. The proportional bypass valve 122, as was noted above, is normally adjusted to maintain a constant ΔP across the metering valve 112. Thus, since $K_1$ is a constant, the flow rate, $W_f$, is controlled by adjusting the area, A, of the first variable area flow orifice 113.

As was noted above, proportional control is implemented by the head sensor to maintain a constant ΔP across the metering valve 112. As was previously noted, proportional control can introduce error. Thus, when the differential pressure drop error ($\Delta P_{ERROR}$) is accounted for, the flow equation is more accurately represented by the following equation (Equation 2):

$$W_F = K_1 \times A_{MV} \times \sqrt{\Delta P_{REF} + \Delta P_{ERROR}},$$

where $\Delta P_{REF}$ is a reference differential pressure value that is determined and set during bypass valve 122 design and acceptance testing.

Figure 2:
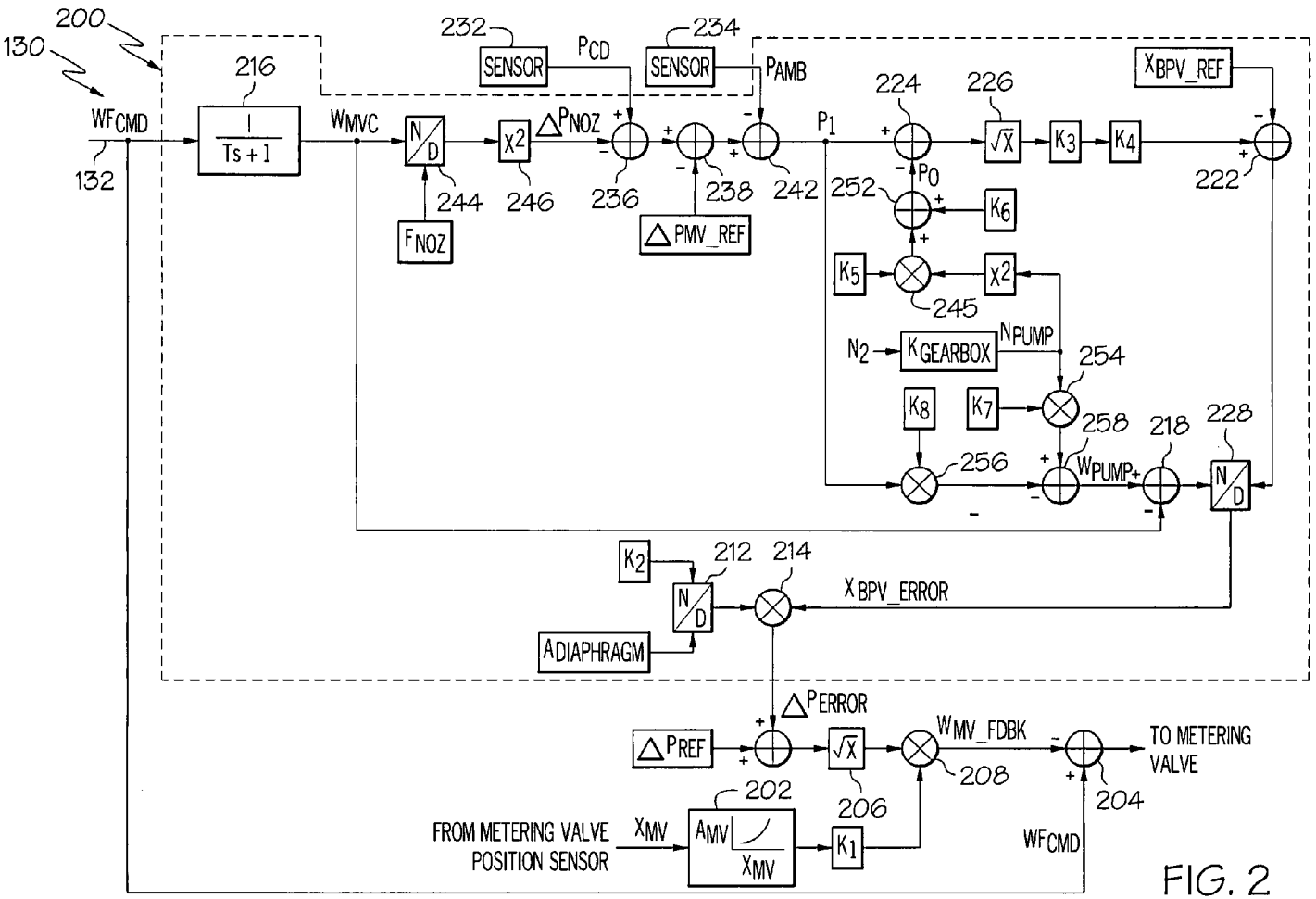
FIG. 2 is a block diagram of at least a portion of an exemplary control circuit used in the fuel delivery and control system depicted in FIG. 1, according to an exemplary embodiment of the present invention.

The control circuit 130 is configured to provide proportional bypass valve error compensation to estimate the differential pressure error ($\Delta P_{ERROR}$). Thus, the area of the first variable area flow orifice 113 is adjusted based at least in part on the differential pressure error. A functional block diagram depicting at least a portion of the control circuit 130 and an error compensation algorithm implemented therein is provided in FIG. 2. It will be appreciated that although the control circuit 130 is depicted in FIG. 2 using functional blocks, this is merely done for clarity and ease of description. Indeed, the control circuit 130, and its associated functions, could be implemented using one or more discrete physical components or be partially or fully implemented in firmware, software, or a combination of both.

Turning now to FIG. 2, it is seen that the control circuit 130 receives a fuel flow command ($WF_{CMD}$) and metering valve position feedback ($X_{MV}$). The fuel flow command may be the input control signal 132 (see FIG. 1), or the input control signal 132 may be processed by other control logic (not-illustrated) within the control circuit 130 and the flow command derived therefrom. In either instance, the flow command is compared to a metering valve flow feedback signal ($W_{MV_FDBK}$) that is determined using Equation 2 above, using the metering valve position feedback ($X_{MV}$), the known function of first variable area flow orifice area ($A_{MV}$) versus metering valve position 202, the constant ($K_1$), the reference differential pressure value ($\Delta P_{REF}$), the differential pressure error ($\Delta P_{ERROR}$), an addition function 204, a square root function 206, and a multiplication function 208. It will be appreciated that the known function of the first variable area flow orifice area ($A_{MV}$) versus metering valve position ($X_{MV}$), the constant ($K_1$), and the reference differential pressure value ($\Delta P_{REF}$) are each stored in one or more memories 134 (see FIG. 1), which may form part of, or be separate from, the control circuit 130.

The differential pressure error ($\Delta P_{ERROR}$) is determined using an algorithm 200 that is based on a set of state equations for various system components that impact proportional head regulation, and thus the resulting bypass valve position. The algorithm determines (or estimates) the differential pressure error ($\Delta P_{ERROR}$) by determining (or estimating) the position of the proportional bypass valve 122 relative to a known reference position ($X_{BPV_REF}$), and is based on state equations developed around various measurable or predictable parameters. In the preferred embodiment, these parameters include flow through the bypass valve 122, bypass valve displacement from the reference position ($X_{BPV_ERROR}$), flow through the fuel pump 110 ($W_{PUMP}$), the flow number of combustor fuel nozzles 105 ($F_{NOZ}$), and metering valve dynamics.

With the above background in mind, the differential pressure error ($\Delta P_{ERROR}$) is determined from a known relationship for the proportional bypass valve 122. In particular, when used with the spring-biased, diaphragm-type head sensor 128 described above, the proportional bypass valve 122 may be described by the following relationship:

$$\Delta P \times A_{DIAPHRAGM} = K_2 \times X_{BPV},$$

where $A_{DIAPHRAGM}$ is the area of the diaphragm 127, $K_2$ is the spring constant of the spring 129, and $X_{BPV}$ is the position of the bypass valve 122 through the compressed distance of the spring 129. It will be appreciated that $X_{BPV}$ is additionally described by the following relationship:

$$X_{BPV} = X_{BPV_REF} + X_{BPV_ERROR}.$$

From this, it may thus be seen that $\Delta P_{ERROR}$ is described by the following relationship:

$$\Delta P_{ERROR} = \frac{K_2}{A_{DIAPRAGM} \times X_{\mathrm{BPV_ERROR}}}.$$

Thus, as shown in FIG. 2, the differential pressure error ($\Delta P_{ERROR}$) is determined using stored values of the diaphragm area ($A_{DIAPHRAGM}$) and the spring constant ($K_2$), the bypass valve displacement from the reference position ($X_{BPV_ERROR}$), a division function 212, and a second multiplier function 214.

In the depicted embodiment, the bypass valve displacement from the reference position ($X_{BPV_ERROR}$) is a value that is determined based at least in part on flow through the fuel pump 110 ($W_{PUMP}$) and the fuel flow command ($WF_{CMD}$). More specifically, as may be appreciated, fuel flow through the bypass valve ($W_{BPV}$) may be described by two relationships. The first relationship is:

$$W_{BPV} = W_{PUMP} - WF_{MVC},$$

where $W_{MVC}$ is calculated metered fuel flow, which is determined with sufficient accuracy by filtering the fuel flow command ($WF_{CMD}$) using a first-order lag filter 216. The second relationship that describes bypass valve fuel flow is:

$$W_{BPV} = K_3 \times A_{BPV} \times (P_1 - P_0)^{0.5},$$

where K3 is a flow constant that is a function of fuel density, fuel temperature, and bypass valve discharge coefficient (CD), $A_{BPV}$ is the area of the second variable area flow orifice 123, $P_1$ is fuel pump 110 discharge pressure, and $P_0$ is a fuel control reference pressure that is set by the booster pump 108. Before proceeding further it is noted that although use of the fuel flow command ($WF_{CMD}$) is preferred, in part because it is a variable that is independent of the final value that is being calculated, it will be appreciated that in an alternative embodiment measured fuel flow (Wf), which is the final dependent variable that is being calculated, could instead be used.

The area of the second variable area flow orifice 123 ($A_{BPV}$) is described by:

$$A_{BP} = K_4 \times X_{BPV},$$

where $K_4$ is a constant that is based on the assumption that the relationship between bypass valve stroke and area is linear. When this equation is solved in terms of bypass valve flow ($W_{BPV}$), it yields the following:

$$X_{BPV} = \frac{W_{BPV}}{K_3 \times K_4 \times (P_1 - P_0)^{0.5}}.$$

Because, as was previously noted, bypass valve position ($X_{BPV}$) is described by:

$$X_{BPV} = X_{BPV_REF} + X_{BPV_ERROR},$$

it follows that bypass valve displacement from the reference position ($X_{BPV_ERROR}$) may be described by the following relationship:

$$\Delta X_{\text{BPV_ERROR}} = \frac{W_{BPV}}{K_3 \times K_4 \times (P_1 - P_0)^{0.5}} - X_{\text{BPV_REF}}.$$

From the above relationships, it may thus be seen that bypass valve displacement from the reference position ($X_{BPV_ERROR}$), in terms of fuel pump flow ($W_{PUMP}$) and the fuel flow command ($WF_{CMD}$) is described by:

$$\Delta X_{\text{BPV_ERROR}} = \frac{W_{PUMP} - W_{MVC}}{K_3 \times K_4 \times (P_1 - P_0)^{0.5}} - X_{\text{BPV_REF}}.$$

Thus, as shown in FIG. 2, bypass valve displacement from the reference position ($X_{BPV_ERROR}$) is determined using determined values of fuel pump discharge pressure ($P_1$), fuel control reference pressure ($P_0$), fuel pump flow ($W_{PUMP}$), and calculated metered fuel flow ($W_{MVC}$), stored values of the reference bypass valve position ($X_{BPV_REF}$), the bypass valve flow constant ($K_3$), and the linear relationship constant ($K_4$), second, third, and fourth subtraction functions 218, 222, 224, a second square root function 226, and a second division function 228. Again, although use of the fuel flow command ($WF_{CMD}$) is preferred, it will be appreciated that measured fuel flow (Wf) could alternatively be used. Nonetheless, it is noted that fuel pump discharge pressure ($P_1$), fuel control reference pressure ($P_0$), and fuel pump flow ($W_{PUMP}$), are each determined from various stored and measured parameters. A more detailed description of how fuel pump discharge pressure ($P_1$), fuel control reference pressure ($P_0$), and fuel pump flow ($W_{PUMP}$) are determined will now be described, beginning with fuel pump discharge pressure ($P_1$).

Fuel pump discharge pressure ($P_1$) is determined from various engine and system pressures. In the depicted embodiment, these pressures include engine compressor discharge pressure ($P_{CD}$), fuel nozzle differential pressure ($\Delta P_{NOZ}$), a reference metering valve differential pressure value ($\Delta P_{MV_REF}$), and ambient pressure ($P_{AMB}$). In particular, fuel pump discharge pressure is determined by subtracting fuel nozzle differential pressure ($\Delta P_{NOZ}$), reference metering valve differential pressure ($\Delta P_{MV_REF}$), and ambient pressure ($P_{AMB}$) from the compressor discharge pressure ($P_{CD}$). The compressor discharge pressure ($P_{CD}$) is measured via a compressor discharge sensor 232 that supplies a signal representative thereof, either directly or via other circuitry, to the control circuit 130. The ambient pressure ($P_{AMB}$) is measured via an ambient pressure sensor 234 that supplies a signal representative thereof, either directly or via other circuitry, to the control circuit 130. The reference metering valve differential pressure ($\Delta P_{MV_REF}$) is a constant differential pressure value that is known based on metering valve 112 design and acceptance testing. Thus, the fuel pump discharge pressure ($P_1$) is determined using the signal representative of compressor discharge pressure ($P_{CD}$) supplied from the compressor discharge sensor 232, the signal representative of ambient pressure ($P_{AMB}$) supplied from the ambient pressure sensor 234, a stored value representative of the reference metering valve differential pressure ($\Delta P_{MV_REF}$), the fuel nozzle differential pressure ($\Delta P_{NOZ}$), and fifth, sixth, and seventh subtraction functions 236, 238, 242. It will be appreciated that these pressures are merely exemplary of particular pressure drops within the depicted system 100 and that additional pressure drops could, or may need to be, accounted for in determining fuel pump discharge pressure ($P_1$). For example, if the system 100 is implemented with a pressuring or shut-off valve, the pressure drop thereacross may also need to be accounted for.

As with the pump discharge pressure ($P_1$), the fuel nozzle differential pressure ($\Delta P_{NOZ}$) is determined from various parameters. In particular, this value is determined based on the previously described calculated metered fuel flow ($W_{MVC}$), and a fuel nozzle flow number ($FN_{NOZ}$), which is known by design, and is described by the following relationship:

$$\Delta P_{NOZ} = \left(\frac{W_{MV}}{FN_{NOZ}}\right)^2.$$

Thus, as shown in FIG. 2, the fuel nozzle differential pressure ($\Delta P_{NOZ}$) is determined using the calculated metered fuel flow ($W_{MVC}$), a stored value of the fuel nozzle flow number ($FN_{NOZ}$), a third division function 244, and a squaring function 246.

Fuel control reference pressure ($P_0$), as noted above, is set by the booster pump 108. More specifically, for the preferred embodiment, in which the booster pump 108 is a centrifugal pump, the fuel control reference pressure is a function of the square of the booster pump rotational speed ($N_{PUMP}$). In particular, since the booster pump 108 is an engine driven centrifugal pump, the fuel control reference pressure ($P_0$) is described by the following relationship:

$$P_0 = K_5 \times N_{PUMP}^2 + K_6,$$

where $K_5$ and $K_6$ are each constants associated with the booster pump 108. It is noted that booster pump speed ($N_{PUMP}$) is a function of engine speed, and more particularly, a function of engine high pressure spool speed ($N_2$) and the gearbox ratio ($K_{GEARBOX}$) associated with a non-illustrated gearbox that may be disposed between the engine and the booster pump 108. Thus, as FIG. 2 additionally depicts, fuel control reference pressure ($P_0$) is determined using a signal representative of engine speed ($N_2$), stored values of the booster pump constants ($K_5$, $K_6$), a second multiplication function 245, and a second addition function 252.

Turning now to fuel pump flow ($W_{PUMP}$), it is noted that this parameter may be described by the following relationship:

$$W_{PUMP} = (K_7 \times N_{PUMP}) - (K_8 \times P_1),$$

where $K_7$ is a constant associated with the fuel pump 110, $K_8$ is a constant for flow reduction due to pump back pressure, $N_{PUMP}$ is engine-driven fuel pump speed, and $P_1$ is, as was previously noted, fuel pump discharge pressure. Fuel pump speed ($N_{PUMP}$), like booster pump speed, is a function of engine speed. Indeed, in the depicted embodiment, both pumps 108, 110 are driven at the same speed, and thus use the same pump speed value ($N_{PUMP}$). Thus, as further depicted in FIG. 2, fuel pump flow ($W_{PUMP}$) is determined using a signal representative of engine speed ($N_2$), stored values of the fuel pump constants ($K_7$, $K_8$), fuel pump discharge pressure ($P_1$), third and fourth multiplication functions 254, 256, and an eighth addition function 258.

The control circuit 130 configuration described herein compensates for proportional pressure droop error in fuel flow control system, and does so by implementing a methodology that is relatively non-complex, and thus less costly as compared to other, more complex methodologies.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. In a fuel metering system including a metering valve and a proportional bypass valve that produces a differential pressure error across the metering valve, a method of controlling fuel flow in the fuel metering system, comprising the steps of:

supplying fuel from a fuel source to a supply line, the supply line having at least an outlet port;

directing a first fraction of the fuel in the supply line through the metering valve to the supply line outlet port, the metering valve having a first variable area flow orifice;

directing a second fraction of the fuel in the supply line through the proportional bypass valve back to the fuel source, the proportional bypass valve having a second variable area flow orifice;

continuously estimating the differential pressure error produced by the bypass valve using an algorithm; and controlling fuel flow to the supply line outlet port by (i) adjusting the area of the first variable area flow orifice based at least in part on the estimated differential pressure error and (ii) adjusting the area of the second variable area flow orifice to maintain a substantially constant metering valve differential pressure across the first variable area orifice.

2. The method of claim 1, further comprising:

supplying a fuel flow command representative of a desired fuel flow to the supply line outlet; and adjusting the area of the first variable area flow orifice based additionally on the supplied fuel flow command.

3. The method of claim 2, further comprising:

determining a reference differential pressure value that is representative of a desired constant differential pressure across the first variable area orifice;

adding the estimated differential pressure error to the desired constant differential pressure error to determine an actual differential pressure value; and adjusting the area of the first variable area flow orifice based on the determined actual differential value and the supplied flow command.

4. The method of claim 1, further comprising:

determining a proportional bypass valve position error, wherein the algorithm continuously estimates the differential pressure error based at least in part on the determined proportional bypass valve position error.

5. The method of claim 4, wherein:

the proportional bypass valve includes a valve element, a spring, and a diaphragm, the spring having a spring constant and biasing the valve element toward a valve position, and the diaphragm having an area across which the metering valve differential pressure is applied; and the algorithm continuously estimates the differential pressure error from the spring constant, the diaphragm area, and the determined proportional bypass valve position error.

6. The method of claim 4, further comprising:

supplying a fuel flow command representative of a desired fuel flow to the supply line outlet;

supplying fuel flow from the fuel source to the supply line via a fuel pump; and determining fuel flow through the fuel pump, wherein the algorithm continuously estimates the proportional bypass valve position error based at least in part on the determined fuel flow through the fuel pump and the supplied fuel flow command.

7. The method of claim 6, further comprising:

determining fuel pump rotational speed;

determining fuel pump discharge pressure; and determining the fuel flow through the fuel pump based at least in part on the determined fuel pump rotational speed and the determined fuel pump discharge pressure.

8. The method of claim 6, further comprising:

selecting a reference proportional bypass valve position, the reference proportional bypass valve position representative of a position at which the differential pressure error produced thereby is assumed to be zero, wherein the algorithm continuously estimates the differential pressure error based at least in part on the determined fuel flow through the fuel pump, the supplied fuel flow command, and the reference proportion bypass valve position.

9. The method of claim 8, further comprising:

determining fuel pump discharge pressure;

determining a fuel control reference pressure, wherein the algorithm continuously estimates the differential pressure error based at least in part on the determined fuel flow through the fuel pump, the supplied fuel flow command, the determined fuel pump discharge pressure, the determined fuel control reference pressure, and the reference proportion bypass valve position.

10. The method of claim 9, further comprising:

calculating a pressure difference between the fuel pump discharge pressure and the fuel control reference pressure, wherein the algorithm continuously estimates the differential pressure error based at least in part on the determined fuel flow through the fuel pump, the supplied fuel flow command, the calculated pressure difference, and the reference proportion bypass valve position.

11. A fuel metering system for control fuel flow to a gas turbine engine, comprising:

a fuel supply line having an inlet adapted to couple to a fuel source and an outlet adapted to couple to the gas turbine engine;

a metering valve positioned in flow-series in the supply line, the metering valve producing a differential pressure thereacross when fuel flows therethrough;

a bypass flow line coupled to the fuel supply line upstream of the metering valve for bypassing a portion of the fuel in the supply line back to the inlet;

a proportional bypass valve positioned in flow-series in the bypass flow line and configured to control flow therethrough to maintain a substantially constant differential pressure across the metering valve, the substantially constant differential pressure including a differential pressure error produced by the proportional bypass valve; and a control circuit adapted to receive a fuel flow command representative of a desired fuel flow and operable to (i) continuously estimate the differential pressure error using an algorithm and (ii) adjust the metering valve, based at least in part on the continuously estimated differential pressure error and the fuel flow command, to supply fuel through the metering valve at the desired fuel flow.

12. The system of claim 11, further comprising:

memory having stored therein a reference differential pressure value that is representative of a desired constant differential pressure across the fuel metering valve, wherein the control circuit is further operable to (i) add the continuously estimated differential pressure error to the desired constant differential pressure error to determine an actual differential pressure value and (ii) adjust the metering valve based on the actual differential value and the supplied flow command.

13. The system of claim 11, wherein the control circuit is operable to:

determine a proportional bypass valve position error; and continuously estimate, using the algorithm, the differential pressure error based at least in part on the determined proportional bypass valve position error.

14. The system of claim 13, wherein:

the proportional bypass valve comprises a valve element, a spring, and a diaphragm, the spring having a spring constant and configured to bias the valve element toward a valve position, and the diaphragm having an area across which the differential pressure is applied;

the memory has stored therein values representative of the spring constant and the diaphragm area; and the control circuit continuously estimates, using the algorithm, the differential pressure error from the spring constant, the diaphragm area, and the determined proportional bypass valve position error.

15. The system of claim 13, further comprising:

a fuel pump configured to supply fuel to the supply line, wherein the control circuit is further operable to determine fuel flow through the fuel pump and determine the proportional bypass valve position error based at least in part on the determined fuel flow through the fuel pump and the supplied fuel flow command.

16. The system of claim 15, further comprising:

a lag filter coupled to receive the fuel flow command and operable, upon receipt thereof, to supply a filtered fuel flow command, wherein the control circuit is operable to continuously estimate, using the algorithm, the differential pressure error based at least in part on the determined fuel flow through the fuel pump, the filtered fuel flow command, and the determined proportional bypass valve position error.

17. The system of claim 15, wherein:

the fuel pump rotates and supplies fuel at a discharge pressure; and the control circuit is further operable to determine (i) fuel pump rotational speed, (ii) fuel pump discharge pressure, and (iii) the fuel flow through the fuel pump based at least in part on the determined fuel pump rotational speed and the determined fuel pump discharge pressure.

18. The system of claim 17, wherein:

the memory stores a reference proportional bypass valve position value representative of a position at which the differential pressure error produced thereby is assumed to be zero; and the control circuit continuously estimates, using the algorithm, the differential pressure error based at least in part on the determined fuel flow through the fuel pump, the supplied fuel flow command, and the reference proportion bypass valve position value.

19. The system of claim 18, further comprising:

a gearbox disposed between the gas turbine engine and the fuel pump, the gearbox configured to couple rotational drive force supplied from the gas turbine engine to the fuel pump;

an engine speed sensor configured to sense a rotational speed of a component in the gas turbine engine and supply an engine speed signal representative thereof, wherein the control circuit is coupled to receive the engine speed signal and is configured to determine the fuel pump rotational speed therefrom.

20. The system of claim 19, further comprising:

a boost pump disposed upstream of the fuel supply pump and operable to supply fuel thereto at a substantially constant fuel control reference pressure, wherein the control circuit is further operable to:

determine the fuel pump discharge pressure, determine the fuel control reference pressure from the engine speed signal, and estimate, using the algorithm, the differential pressure error based at least in part on the determined fuel flow through the fuel pump, the supplied fuel flow command, the determined fuel pump discharge pressure, the determined fuel control reference pressure, and the reference proportion bypass valve position.

21. The system of claim 20, wherein the control circuit is further operable to:

calculate a pressure difference between the fuel pump discharge pressure and the fuel control reference pressure; and estimate, using the algorithm, the differential pressure error based at least in part on the determined fuel flow through the fuel pump, the supplied fuel flow command, the calculated pressure difference, and the reference proportion bypass valve position.

22. The system of claim 20, further comprising:

a compressor discharge pressure sensor configured to sense compressor discharge pressure of a compressor in the gas turbine engine and supply a compressor discharge pressure signal representative thereof and an ambient pressure sensor configured to sense ambient pressure around the system and supply an ambient pressure signal representative thereof, wherein:

the memory stores (i) a metering valve differential pressure reference value representative of a predetermined design differential pressure across the metering valve and (ii) a fuel nozzle flow number representative of a predetermined flow number associated with one or more engine fuel nozzles, and the control circuit is coupled to receive the compressor discharge pressure signal and the ambient pressure signal and is operable to determine pump discharge pressure from the compressor discharge pressure signal, the ambient pressure signal, the metering valve differential pressure reference value, and the fuel nozzle flow number.

23. The system of claim 22, further comprising:

a lag filter coupled to receive the fuel flow command and operable, upon receipt thereof, to supply a filtered fuel flow command, wherein the control circuit is operable to (i) determine a fuel nozzle differential pressure based on the fuel nozzle flow number and the filter fuel flow command and (ii) determine pump discharge pressure from the compressor discharge pressure signal, the ambient pressure signal, the metering valve differential pressure reference value, and the fuel nozzle differential pressure.

* * * * *